United States Patent [19]

Barbe

[11] Patent Number: 4,770,226

[45] Date of Patent: Sep. 13, 1988

[54] MACHINE FOR CONTINUOUS CASTING OF METAL IN THE FORM OF STRIPS

[75] Inventor: Jacques Barbe, Saint-Etienne, France

[73] Assignee: CLECIM, Courbevoie, France

[21] Appl. No.: 867,826

[22] Filed: May 28, 1986

[30] Foreign Application Priority Data

May 28, 1985 [FR] France ..... 85 07985

[51] Int. Cl.[4] ..... B22D 11/00

[52] U.S. Cl. ..... 164/415; 164/420; 164/124; 164/338.1

[58] Field of Search ..... 164/122, 338.1, 415, 164/420, 437, 488, 124

[56] References Cited

U.S. PATENT DOCUMENTS

| | | | |
|---|---|---|---|
| 3,343,594 | 9/1967 | Dain | 164/420 |
| 3,558,256 | 1/1971 | Bick et al. | 164/420 |
| 3,780,789 | 12/1973 | Unger | 164/420 |
| 3,788,383 | 1/1974 | Metz | 164/437 |
| 3,834,447 | 9/1974 | Luchok et al. | 164/420 |
| 4,036,284 | 7/1977 | Hoffmann | 164/420 |
| 4,224,977 | 9/1980 | Cygler et al. | 164/443 |
| 4,291,747 | 9/1981 | Sevestakis | 164/420 |
| 4,562,876 | 1/1986 | Hargassner et al. | 164/420 |

FOREIGN PATENT DOCUMENTS

| | | | |
|---|---|---|---|
| 1608350 | 12/1970 | Fed. Rep. of Germany . | |
| 985233 | 7/1951 | France . | |
| 1211632 | 3/1960 | France . | |
| 953857 | 4/1964 | United Kingdom | 164/420 |

*Primary Examiner*—Nicholas P. Godici
*Assistant Examiner*—Richard K. Seidel
*Attorney, Agent, or Firm*—Pollock, VandeSande & Priddy

[57] ABSTRACT

Machine for the continuous casting of metal in the form of at least two separate strips, comprising a tundish (1) supplied with liquid metal, a bottomless mold (2) supplied continuously by the tundish (1), and an extraction and secondary cooling device (4). The liquid metal is poured into a distributor vessel (3) interposed between the tundish (1) and the mold (2), the vessel (3) placed on the mold (2), secured to the latter and equipped with means of maintaining the metal at the casting temperature.

9 Claims, 3 Drawing Sheets

1
11
e2
e1
H
h
61
6
12
3
33
32
35
e
24
2
31
34
23
21
20
25
7
25
212
250
22
210
60
40
4
94
93
92
95
9
91
15
13
14
18
16
180
181
60
19
19
60
17
60
170
172
171

11
12
36
32
3
33
31
35
87
24
34
8
84
85
86
82
87
80
81
83
e3
P
23
26
60
21
250
62
210
28
27
25
7
P'
64
71
72
73
74
l

MACHINE FOR CONTINUOUS CASTING OF METAL IN THE FORM OF STRIPS

FIELD OF THE INVENTION

The invention relates to a machine for continuous casting of metal in the form of at least two strips of relatively small thickness, for example of the order of 20 to 70 mm, and of considerable width which can, for example, be up to 2 meters.

BACKGROUND OF THE INVENTION

The continuous casting of metal, especially steel, is now on an industrial scale and makes it possible to cast not only bars, often called billets, but also slabs, i.e., metal sheets of substantial width which, for example, can exceed 2 meters.

In general terms, a continuous-casting installation comprises, in the casting direction, a tundish intended for receiving the liquid metal coming from the steel plant in ladles, a bottomless mold and a device for extraction and secondary cooling.

The tundish serves to ensure casting continuity, especially when a ladle which is finished casting is replaced. The bottomless mold located underneath the tundish and supplied continuously from the latter consists of two parallel longitudinal walls and two transverse walls mounted on a frame and limiting a casting cavity of rectangular cross-section for the casting of slabs, the large sides being formed by the longitudinal walls and the small sides by the transverse walls. The walls of the mold are limited inwards by a plate in contact with the metal, usually made of copper and also called a "friction plate". At least the longitudinal walls are equipped with a cooling system which normally consists of channels for the circulation of a liquid coolant, usually water, along the inner face of the contact plate. Consequently, there forms along the cooled contact plates a solidified skin, the thickness of which increases progressively downwards and within which the liquid metal is retained, thus making it possible to extract via the bottom of the mold a strand of metal, the cross-section of which corresponds to that of the mold. To prevent the metal from adhering to the contact plates, the mold is usually subjected to a slight oscillating movement which can be generated by various well-known mechanisms.

The strand of metal issuing from the bottom of the mold then passes into a secondary cooling device which generally consists of a series of guide elements forming a corridor arranged in the extension of the mold and of the same cross-section as the latter, each guide element being equipped with means of retaining and cooling the strand of metal. On the other hand, to make it easier to extract the strand of metal, at least some guide elements are equipped with means which exert a pull on the strand.

Continuous-casting machines originally worked only in a vertical direction, then curved casting machines were produced, and in these the secondary cooling device aligns the strand of metal horizontally, so that the latter can easily be cut into slabs capable of subsequently being rolled in the conventional way.

The known machines possess means of adjusting the dimensions of the cast product, in particular by shifting the longitudinal walls to adjust the thickness of the strand and the transverse walls to adjust its width. However, the possibilities of adjustment remain limited, since each machine is intended for casting products of a certain category. There is, nevertheless, a provision for casting several bars of small width at the same time from a machine designed for casting slabs, the cavity of the mold being divided longitudinally by means of transverse partitions spaced apart from one another, so as to form several cavities placed next to one another and each having a thickness corresponding to the distance between the longitudinal walls. For various reasons, in the known machines, this thickness has to remain relatively substantial, for example at least 100 mm. Consequently, known continuous-casting machines have not to date been used for the continuous casting of strips.

For this purpose, various systems have already been proposed. For example, in French Pat. No. 69 45 157, the metal is introduced from the bottom upwards between two cooled cylinders forming the two walls of the mold in which the strip forms, the latter remaining laid against one of the cylinders until it solidifies. Such systems present many problems and have not been successful on an industrial scale.

To avoid the disadvantages which the development of machines of a new type entails, the subject of the invention is a new arrangement making it possible to produce thin strips on a machine of the conventional type described above, the mode of operation of which is consequently well known.

SUMMARY OF THE INVENTION

According to the invention, the liquid metal is poured into a distributor vessel interposed between the tundish and the mold, the said distributor vessel being placed on the mold, secured to the latter and equipped with means of maintaining the metal at the casting temperature. The mold is divided into at least two parallel casting cavities delimited by at least one intermediate plate interposed between the longitudinal walls of the mold and extending parallel to the latter between the two transverse plates, the intermediate plate being equipped on its two faces with superficial cooling means. The metal poured into the distributor vessel is therefore distributed between the two parallel cavities, to form two strips, the thickness of which corresponds to the distance between the intermediate plate and the corresponding longitudinal wall, and at least the first guide element located underneath the mold is divided longitudinally into at least two parallel cavities, each equipped with means of cooling and pulling the strips leaving the corresponding cavities of the mold.

Preferably, the distributor vessel is limited by longitudinal and transverse walls placed respectively in the extension of those of the mold.

In a particularly advantageous way, the mold and the intermediate partition are equipped, in their upper part, with means of delaying the start of solidification up to a level below the joining plane between the mold and the distributor vessel.

These delay means can comprise a heat shield located in the upper part of each longitudinal wall of the mold and on the two faces of the intermediate partition, the said shield being interposed between the cooling system and the inner contact plate with the metal and extending over the entire width of the casting cavity and up to the level desired for the start of solidification.

Moreover, the intermediate partition is advantageously provided, along its upper edge, with a rim consisting of a sectional piece which is made of porous material and through which can pass an inert gas injected from channels covered by the said rim and supplied with pressurized gas which can be heated previously to a very high temperature. The distributor vessel is likewise equipped, along the lower edges of its longitudinal walls, with two rims consisting of sectional pieces which are made of porous material and through which can pass an inert gas injected from channels covered by the said rims and supplied with pressurized gas.

In a preferred embodiment, the rim of porous material of each longitudinal wall of the distributor vessel forms a descending lip set apart from the lower portion of the wall by a groove-shaped space, into which fits the upper edge of the inner plate of the longitudinal wall of the mold, the latter being made to project above the joining plane between the distributor vessel and the mold, the bottom of the groove being separated from the top of the upper edge by a space supplied with inert gas under pressure and forming the channel for injecting inert gas through the porous rim.

Where the secondary cooling device is concerned, at least the first guide element advantageously consists of a cage-shaped frame, in which are mounted two longitudinal plates and at least one intermediate partition which are placed respectively in the extension of the longitudinal plates and of the intermediate partition of the mold and which are equipped with systems for cooling the faces in contact with the metal, one of the longitudinal plates serving as a reference and being fastened to the frame, and the other longitudinal plate and the intermediate partition being connected to the frame in a way which allows slight transverse displacements associated with transverse clamping jacks.

BRIEF DESCRIPTION OF THE DRAWINGS

The invention will be better understood from the following description of an embodiment given as an example and illustrated in the attached drawings.

DETAILED DESCRIPTION

Figure 1:
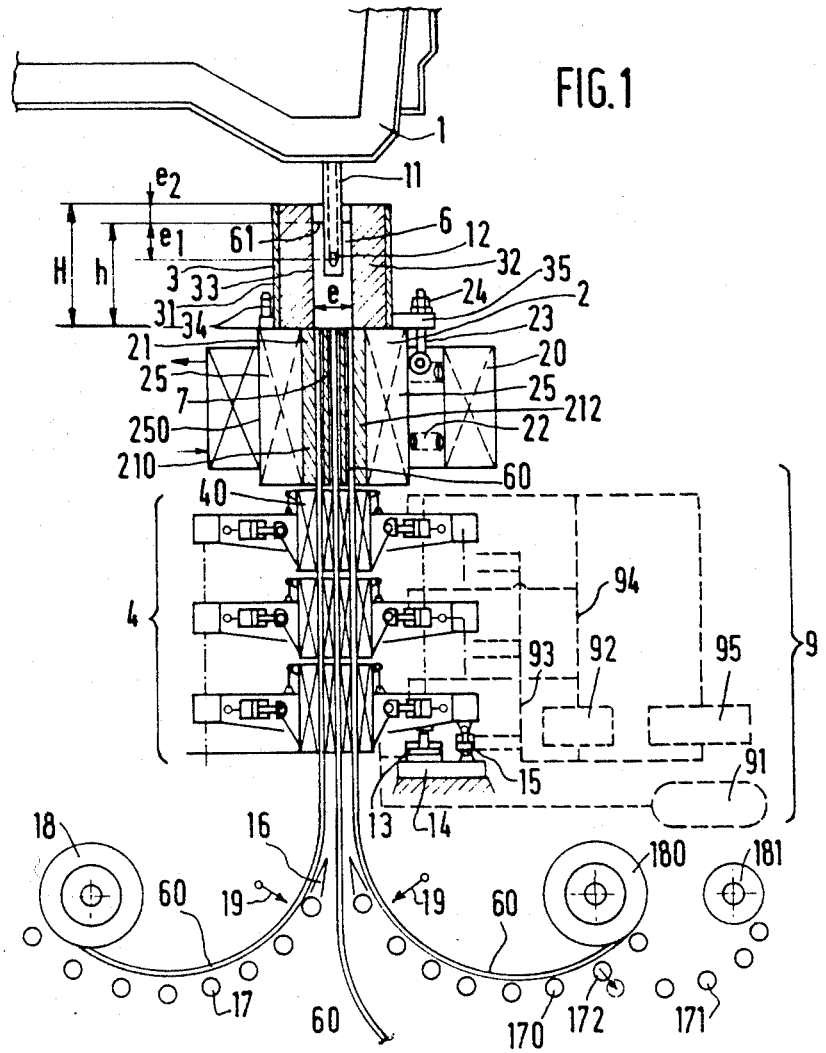
FIG. 1 is a general diagrammatic view of a casting installation according to the invention in a cross-section along a plane perpendicular to that of the strips.

FIG. 1 illustrates diagrammatically an entire installation which comprises, from top to bottom in the casting direction, a tundish 1, a bottomless mold or ingot mold 2 with a distributor vessel 3 located above it, and an extraction and secondary cooling device 4 consisting of a series of guide elements 40, the strips formed being wound onto reeling devices 18.

The metal is cast, from a ladle coming from the steel plant and not shown in the drawings, into a tundish 1 of conventional type, which is adjustable relative to the machine in terms of height and in terms of the horizontal plane.

The tundish 1 is equipped with one or more casting tubes 11 which dip into the bath of liquid steel 6. In conventional installations, the casting tube 11 penetrates inside the mold located diFectly underneath the intermediate vessel. On the contrary, in the invention, a distributor vessel 3 is interposed between the mold 2 and the tundish 1, and the bath of liquid metal, into which the casting tube 11 penetrates, is therefore formed inside the distributor vessel 3. In a well-known way, the casting flow is adjusted, for example by means of a stopper rod or a spout, so as to maintain the level 61 of liquid steel at a height e1 above the outlet orifice 12 of the casting tube 11 and at a safety distance e2 below the upper edge of the distributor vessel 3.

The mold 2, commonly called an ingot mold, conventionally consists of a rectangular frame 20, on which are mounted the walls of the mold. The latter usually comprises two longitudinal walls laid by clamping means 22 against transverse walls which limit the distance between the longitudinal walls and which therefore, in conventional installations, determine the thickness of the cast strip.

The distributor vessel 3 itself consists of a frame 31 covered with refractory walls 32 limiting a rectangular cavity 33. The frame 31 of the distributor vessel 3 is equipped with means 34 of centering it on the frame 20 of the ingot mold 2, the latter on the other hand having removable means 23 of fastening the distributor vessel 3, for example elastic ties, each consisting of a threaded rod 23 which engages into an orifice made in a flange 35 fastened to the base of the frame 31 of the distribitor vessel 3 and onto which is screwed a clamping nut 24 bearing on the flange 35 by means of Belleville washers. In this way, the distributor vessel 3 can be centered and secured relative to the ingot mold 2, while at the same time allowing free expansion.

The width e of the casting cavity 33 must be large enough to ensure that there is no solidification skin between the casting tube 11 and the inner walls of the cavity 33. In practise, this width e should therefore have a minimum value of 200 to 250 mm.

The length of the cavity 33 is equal to the width of the cast strips and consequently to the distance between the transverse plates of the ingot mold 2.

In a known way, the meniscus forming the free surface 61 of the bath of steel 6 is covered with an isothermal powder which has known properties in respect of trapping of the inclusions present in the liquid steel.

The height H of the distributor vessel 3 and the height h of metal maintained in the cavity 33 are determined according to the specific output of the machine.

According to one of the essential feature of the invention, the refractory lining 32 of the distributor vessel 3 is heated vigorously before casting and is maintained at its temperature during casting by means which are easy to put into practise, such as, for example, the circulation of high-temperature gas in channels 36 formed in the refractory 32. The heating is adjusted so as to maintain the metal at the casting temperature. Of course, other means could be used, such as, for example, electrical heating.

Figure 2:
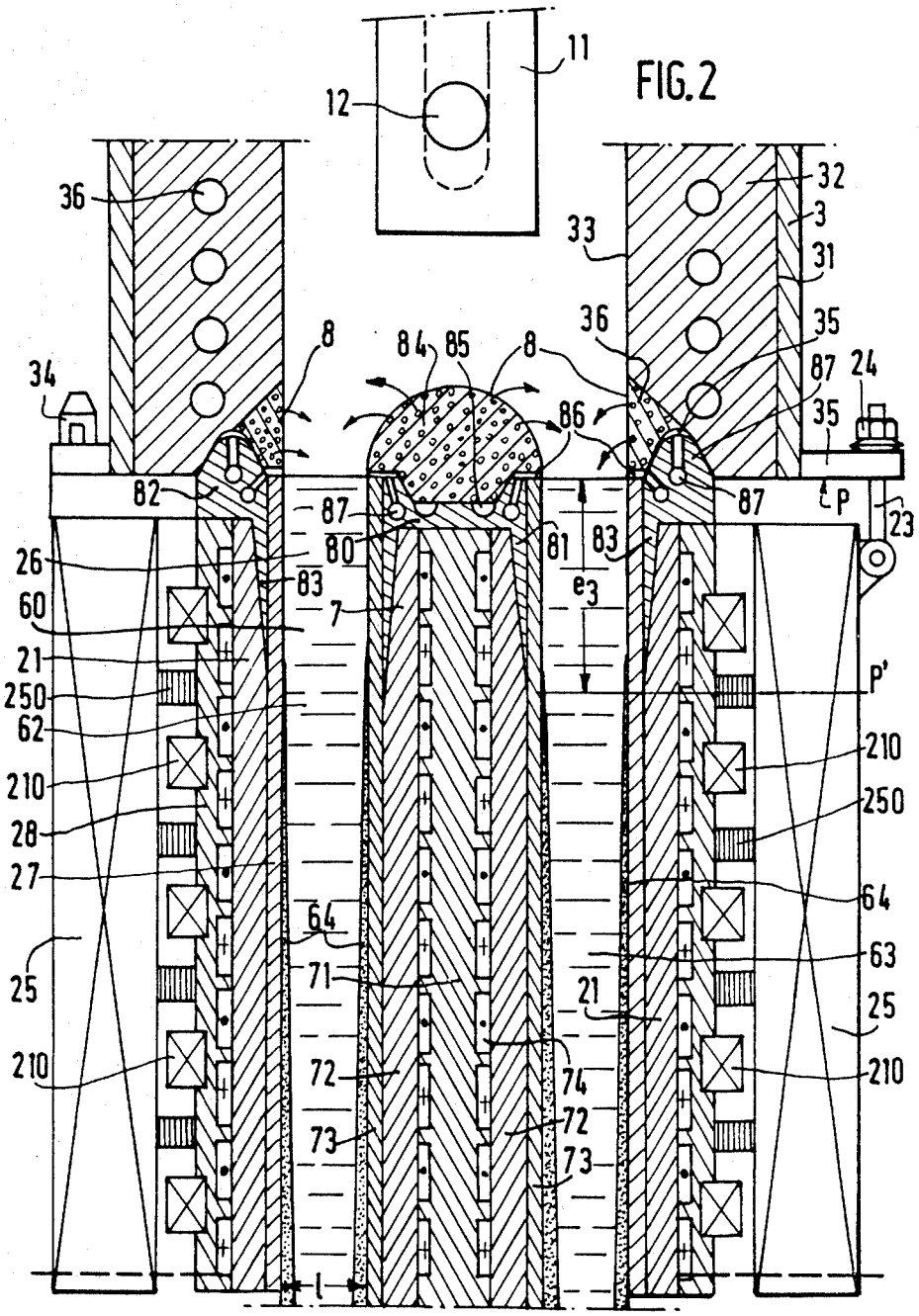
FIG. 2 is detailed view of the upper part of the mold on an enlarged scale.
Figure 2A:
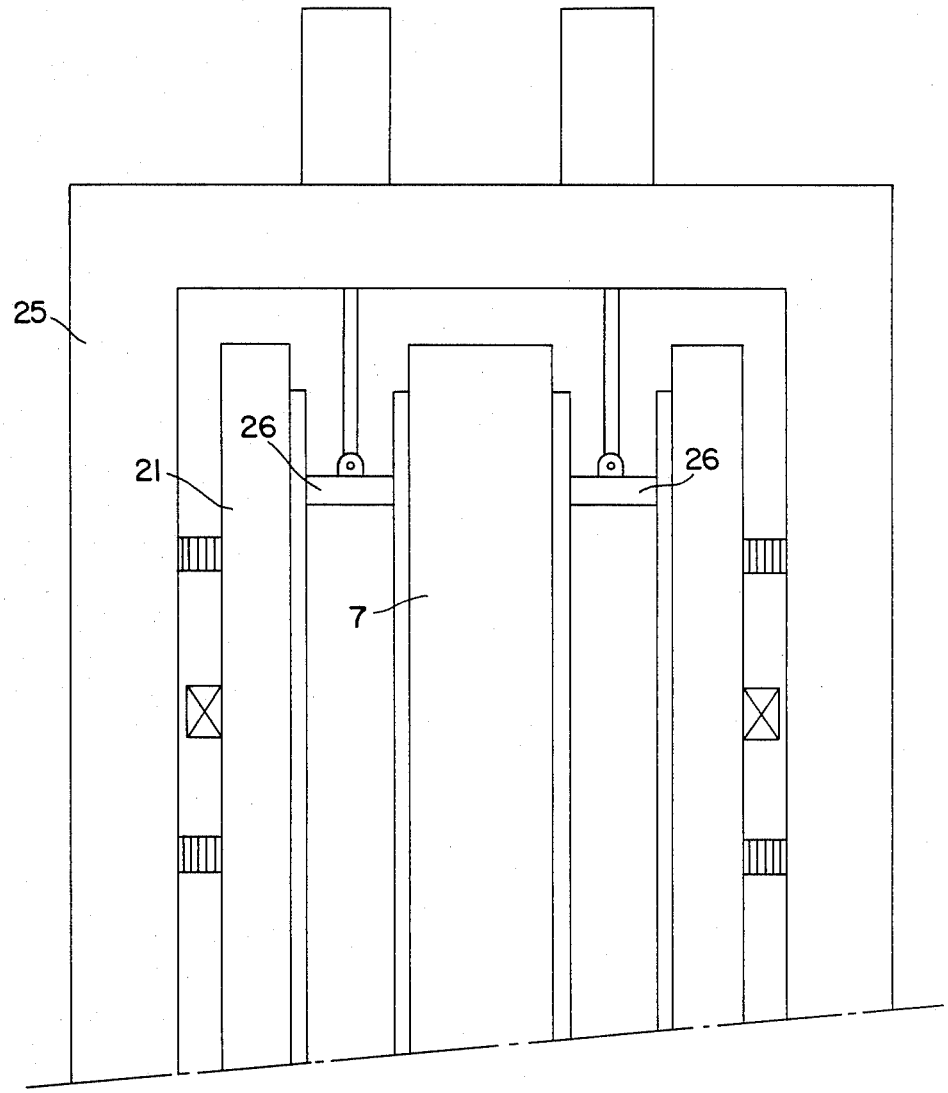
FIG. 2*a* is a schematic section view of the lateral portion of the casting installation of FIG. 1.

According to another essential features of the invention, the ingot mold 2 is divided into at least two parts by means of at least one intermediate partition 7. FIG. 1 illustrates, by way of example, an installation for the continuous casting of three strips 60, in which installation the ingot mold 2 and the guide elements 40 are each divided into three parts by means of two intermediate partitions 7. For greater simplicity, FIG. 2 shows, on an enlarged scale, a single intermediate partition 7 which consequently defines two casting cavities 62 and 63.

Each casting cavity is limited, at its two ends, by transverse plates 26 of a width l, which are interposed between the opposing faces of the intermediate partition 7 and of the corresponding longitudinal wall 21. In a conventional way, the assembly as a whole is contained by plate-holding elements 25 clamped towards one another by the clamping means 22 bearing on the frame 20 of the ingot mold. Preferably, one of the plate-holding elements 250 is laid directly against the frame 20, and the longitudinal wall 210 which it supports thus constitutes the alignment reference for the machine, the other plate-holding element 251 being pushed back by the clamping means 22.

It can therefore be seen that the steel cast inside the distributor vessel 3 and maintained in the liquid state as a result of the heating of the latter can be distributed between the cavities 62 and 63, in which form two steel strips, of which the thickness is determined by the width l of the transverse plates 26 and the width is determined by the distance between the two transverse plates 26 located at the two ends of one and the same cavity. The thickness of the cast strips 60 can be modified by changing the width of the intermediate plates 26 and consequently the distance between the longitudinal walls 21.

There are many well-known means making it possible to adjust the dimensions of the casting cavity, and there is therefore no need to describe them in detail.

Likewise, each longitudinal wall 21 can be formed in the conventional way and, for example, can be covered towards the inside by an inner plate or friction plate 27, usually made of copper, and towards the outside by an outer plate 28, in which cooling-water circulation channels are made.

In a similar way, each intermediate partition 7 consists of a central core 71 parallel to the longitudinal walls 21 and carrying on either side two plates 72 supporting the friction plates 73 and arranged opposite the corresponding plates 27 of the longitudinal walls. Formed inside the core 71 are liquid-coolant circulation channels 74 connected to the cooling-fluid supply and discharge circuit.

According to another advantageous characteristic of the invention, the longitudinal walls 21 and the intermediate partitions 7 are equipped, in their upper part, with devices 8 which make it possible to delay solidification.

Referring, for example, to the intermediate partition 7, the device 8 comprises a U-shaped piece 80 which caps the upper part of the assembly consisting of the central core 71 and support plates 72. On either side of these, the piece 8 is provided with flanks 81 which descend along the support plates 72, decreasing in thickness, and are themselves covered by the friction plates 73 which reach upto the upper level of the ingot mold. In this way, the flanks 81 provide a heat screen between the central part of the intermediate partition and the friction plate 73, the effectiveness of this screen decreasing progressively to a height e3 below the level of the joining plane P between the ingot mold and the distributor vessel. By means of this heat screen, the steel remains liquid substantially down to the lower level P' of the flanks 81. On the other hand, beyond this level, the cooling of the friction plates 73 is ensured, and there forms in the conventional way a skin of solidified metal 64, the thickness of which increases progressively in proportion as the metal advanced downwards, the core of the strip 60 remaining liquid.

In a similar way, each longitudinal wall 21 is capped, in its upper part, by a head 82 provided with flanks 83 which descend along the supporting walls 21 to the level P', being interposed between the said supporting walls and the friction plates 27. As a result of this, therefore, the solidified skin 64 forms along the friction plates 27 only beyond the lower level P' of the flanks 83 forming a heat screen.

Returning now to the intermediate partition 7, it will be seen that this is equipped, along its upper edge, with a rim 84 consisting of a sectional element made of porous material, which covers the entire partition 7 and which is preferably of a form rounded in its upper part, so as to direct the steel contained in the distributor vessel 3 towards the two casting cavities 62 and 63.

The porous rim 84 covers channels 85 hollowed out in the head 8 and supplied under pressure with a neutral gas which passes through the rim 84 in the way indicated by the arrows. This injection of a neutral gas into the metal makes it easier to eliminate inclusions and makes it possible to prevent the steel from adhering to the surface of the intermediate partition, which could result in a narrowing of the entrance of the casting cavity and in the end block the latter. Preferably, the neutral gas will be introduced before casting and will be brought to a high temperature so as to heat the rim 84 before casting and then maintain its temperature during casting.

Two slits 86 are left between the rim 84 and the upper face of the head 8 and of the friction plates 73, and into these slits 86 open channels 87 formed inside the head 80 and supplied with a lubricant mist at a pressure sufficient to overcome the ferrostatic pressure at this level. The slits 86 may be only a few tenths of a millimeter thick. Injection of this lubricant mist makes it possible to prevent the liquid steel from clinging.

It is clear that the arrangements just described are used symmetrically in relation to the vertical axis of the intermediate partition 7. On the other hand, similar arrangements are provided in the upper part of the longitudinal walls 21. For this purpose, the upper edge of the piece 82 covering the longitudinal wall 21 consists of a projecting part 88 which engages into a groove 37 made in the lower face of the distributor vessel 3 in the thickness of the refractory 32. In a similar way to the arrangement described for the intermediate partition 7, the lower part of each longitudinal wall of the distributor vessel 3 consists of a rim 38 made of porous material, and according to an advantageous arrangement this forms a descending lip constituting the inner face of the groove 37. Moreover, the bottom of the groove 37 is separated from the top of the upper edge 88 of the longitudinal wall by a space, into which is injected under pressure a neutral gas which passes through the porous rim 38, as indicated by arrows in FIG. 2, the effect of this injection of neutral gas being that indicated for the intermediate partition 7. Likewise, a slit 86 a few tenths of a millimeter thick is left between the lower edge of the rim 38 and the upper edge of the friction plate 27 and is connected to a channel 87 which is formed in the piece 82 and via which a lubricant mist can be injected under pressure.

Thus, the flow of steel maintained in the liquid state inside the distributor vessel 3 is appropriately branched off between the casting cavities 62 and 63, and, as has been seen, solidification starts at the level P' on all the longitudinal faces of the cast strips.

In addition to the lubrication described above and carried out by means of the channels 87, it is necessary, as in conventional machines, to ensure a break in the mechanical equilibrium at the interface between the friction plate and the liquid steel. For this purpose, it is possible to make the ingot mold oscillate by means well-known for conventional continuous-casting ingot molds and according to the same kinematic laws. However, another arrangement, illustrated in more detail in FIG. 2, can advantageously be used.

According to this arrangement, the plate-holding elements 25 are isolated from the longitudinal walls 21 by interposing elastic elements 250 and by placing vibrators 210 on the outer parts of the longitudinal walls 21. These vibrator elements 210 transmit vibrational energy to all the elements forming the ingot mold either directly or indirectly via the casting strips and end inserts determining their edges.

The cooling channels are formed parallel to the width of the strip and are connected in series. They are advantageously distributed in two separate superimposed zones for each plate, each of these zones being controlled in terms of flow, pressure and temperature. The upper zone is arranged substantially between the levels P and P' of the ingot mold. It makes it possible, in particular, to control the heat exchange or at least the variations in heat exchange between the refractory 32 of the distributor vessel 3 and the ingot mold.

According to another arrangement well known in conventional machines, the lower edge of the ingot mold and, in general terms, all the lower ends of the cooling elements are equipped with teeth ensuring that the strip is supported more effectively.

Figure 3:
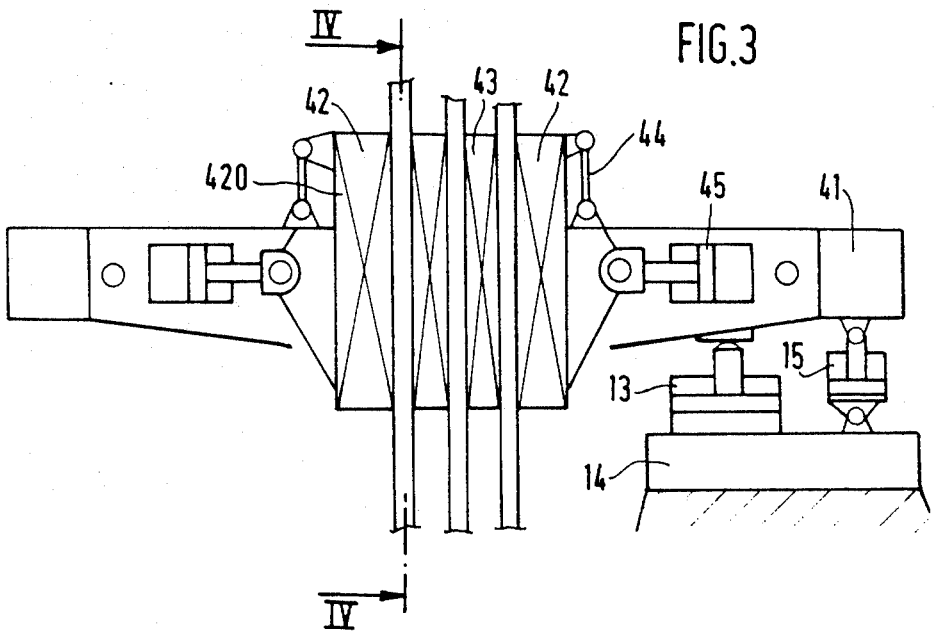
FIG. 3 is a detailed view of a guide element of the secondary cooling device in a cross-section transverse relative to the plane of the strips.

Even if the cast strips are of small thickness, complete solidification has not occurred at the outlet of the ingot mold because of the high casting speed of the order of 5 to 6 meters per minute for a strip 40 mm thick, i.e., a solidification length of 4 to 5 meters. Consequently, the ingot mold 2 is followed by a certain number of secondary cooling elements 40, one of which has been shown in detail in FIGS. 3 and 4.

Each secondary cooling element 40 is supported by an annular frame 41 carrying two outer plates 42 and intermediate plates 43 which are arranged in the extension of the intermediate partitions and which are equal to these in number. One of the outer plates 42 constitutes the reference alignment of the secondary cooling element and is placed in alignment with the longitudinal wall 21 of the mold.

The outer plates 42 are suspended on the frame 41 by means of connecting rods 44, in the same way as the intermediate plates 43, of which the suspension rods located outside the plane of the figure have not been shown.

In the same way as for the ingot mold, the intermediate plates and the outer plates 42 are held apart from one another by means of insert plates which determine the strip thicknesses and which therefore have widths corresponding to those of the inserts 26 of the ingot mold.

The assembly as a whole is balanced and maintained in the upper position by four hydraulic or pneumatic jacks 13 bearing on the foundation block 14. For the sake of simplification, FIG. 1 shows the suspension of only the lowest guide element.

The frame 41 of each guide element is also connected to the foundation block 14 by means of extraction jacks 15, of which the body is articulated on the block 14 and the rod on the frame 41. The jacks as a whole are supplied by means of a device 9 which makes it possible to ensure that the clamping of the plates is synchronized with the displacement of the extraction jacks 15.

Figure 4:
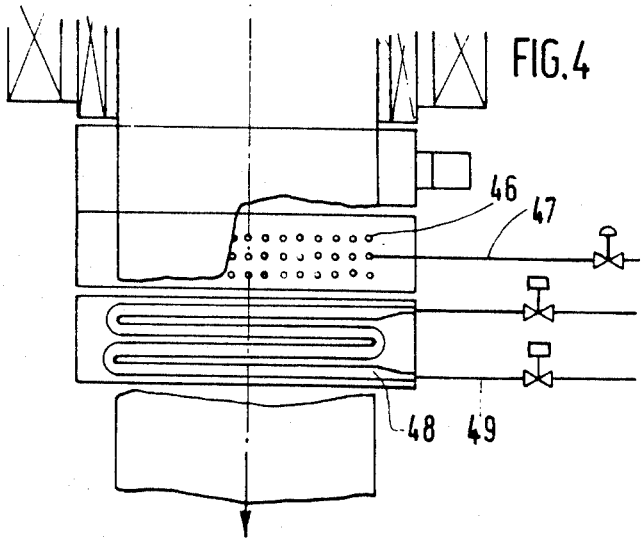
FIG. 4 is a sectional view along line IV—IV of FIG. 3.

The balancing jacks 13 are permanently supplied with pressure by means of a pressure accumulator 91. A hydraulic unit 92 feeds the extraction jacks 15 by means of a circuit 93 and the clamping jacks 45 by means of a circuit 94. An automatic control 95 easy to put into practise and not shown in detail in the drawings makes it possible to synchronize the movements controlled by the jacks. In fact, each cage-shaped guide element executes a reciprocating to-and-fro movement controlled by its extraction jacks 15. The cage is clamped by its jacks 45 during the downward movement and has to be released when it rises again. During this rising movement, it is preferable to avoid the friction of the plates against the strip. For this purpose, as shown in FIG. 4, each plate of the guide cage is provided, in its upper part and at a certain height, with orifices 46 connected to a compressed-air supply circuit 47. Thus, by blowing air, the strip can be detached from the plate during the upward movement, and the compressed air can advantageously be laden with a lubricant to prevent any risk of seizure during the upward movement of the plates. The compressed-air circuit 47 is maintained under pressure and can be equipped with a simple isolating valve, so that blowing does not take place when the plates are clamped. In this way, the response time for the plates to move apart is virtually zero.

Moreover, below the air-blowing network 46, the plates are equipped with water circulation channels 48 supplied by means of a circuit 49 equipped with regulating valves which make it possible to adjust the flow and pressure of the water and consequently the cooling temperature.

The secondary cooling device comprises at least two extraction and guide cages, so that there is always at least one cage engaged over the strips, whatever the opening position of the other cages.

As on a conventional machine, the casting operation is started by means of dummy bars corresponding to each of the cast strips. Thus, according to the number of casting cavities, a corresponding number of strips, for example three strips in the installation shown in FIG. 1, is produced. Casting and extraction are common to the three strips. On leaving the extraction station, the strips are oriented by deflectors 16 towards roller tables 17 which direct each strip towards a winding spindle 18. A cutting station 19 of a known type, represented symbolically in the figure, cuts the strip 60 to the required length when the reel wound on the spindle 18 reaches the desired weight.

To ensure the continuity of the casting operations, each of the lines should be equipped with two winders 180, 181 associated with roller tables 170, 171 and with a switching roller 172 making it possible to direct the strip towards one of the winders or the other. Since the essential advantage of the invention is that the technique which has become conventional for the continuous casting of slabs can be used for the casting of thin strips, the various arrangements adopted in this technique can be put into practise with the desired modifications.

I claim:

1. A machine for continuous casting of metal in the form of at last two strips of metal having a thickness, comprising (a) a tundish receiving liquid metal from a steel plant and equipped with at least one casting tube;

(b) a bottomless ingot mold mounted on an oscillating frame and comprising two parallel longitudinal walls constituting the larger sides of a casting cavity of rectangular cross-section;

(c) a system for cooling the internal face of at least said longitudinal walls;

(d) a distributor vessel interposed between said tundish and said mold and consisting of a frame covered with refractory walls delimiting a rectangular cavity into which said at least one casting tube penetrates;

(e) means for centering and securing said distributor vessel relative to said ingot mold;

(f) at least one intermediate partition interposed in said ingot mold between and parallel to said longitudinal walls for dividing said ingot mold into at least two parallel casting cavities, each cavity being limited at its two ends by transverse plates having a width which may be less than 100 mm, said transverse plates being interposed between opposing faces of said at least one intermediate partition and of said corresponding longitudinal walls;

(g) superficial cooling means for the two faces of said intermediate partition;

(h) heating means of said distributor vessel for maintaining said bath of metal at casting temperature, said metal being distributed between said two parallel cavities of said ingot mold for forming two strips of a thickness corresponding to the distance between said intermediate partition and the corresponding longitudinal wall;

(i) a series of guide elements forming an extraction and secondary cooling device for said strips, each guide element being divided longitudinally into at least two parallel cavities respectively arranged in a prolongation of the corresponding cavities of said ingot mold and having the same cross-section as the latter;

(j) said guide elements being equipped with means for pulling and cooling said strips leaving corresponding cavities of said ingot mold.

2. A continuous-casting machine as claimed in claim 1, wherein at least the first guide element (40) of the secondary cooling device (4) consists of a cage-shaped frame (41), in which are mounted two longitudinal plates (42) and at least one intermediate partition (43) which are arranged respectively in the extension of the longitudinal plates (21) and of said intermediate partition (7) of said mold (2) and which are equipped with systems for cooling the faces in contact with the metal, and wherein, with one of the longitudinal plates (420) serving as a reference and fastened to said frame (41), said intermediate partition (43) and the other longitudinal plate are connected to said frame (41) by means of clamping jacks which allows slight transverse displacements and are associated with transverse clamping jacks (45).

3. A continuous-casting machine according to claim 1, wherein the at least two strips of metal have a thickness which may be less than 100 mm.

4. A continuous-casting machine as claimed in claim 1, wherein said longitudinal walls (21) and said intermediate partition (7) are equipped, in their upper part, with means (8) for delaying the start of solidification up to a level (P') which is the lower level of flanks (81) below the joining plate (P) which is the joining plane between said mold (2) and said distributor vessel (3).

5. A continuous-casting machine as claimed in claim 4, wherein said means (8) for delaying the start of solidification comprise a heat screen (83, 81) arranged in the upper part of each said longitudinal wall (21) of said mold (2) and on the two faces of said intermediate partition (7), said shield (8) being covered by a friction plate (27) in contact with the metal and extending over the entire width of said casting cavity (62) as far as the level P' desired for the start of solidification.

6. A continuous-casting machine as claimed in any one of claims 1 and 3 to 5, wherein said intermediate partition (7) is equipped, along its upper edge, with a rim (84) which consists of a sectional piece made of porous material and through which can pass an inert gas from channels (85) supplied with pressurized gas.

7. A continuous-casting machine as claimed in any one of claims 1 and 3 to 5, wherein said distributor vessel (3) is equipped in its lower part, along the lower edges of its longitudinal walls (33), with two rims (36) consisting of sectional pieces which are made of porous material and through which can pass an inert gas injected from channels (87) formed along said rims (36) and supplied with inert gas under pressure.

8. A continuous-casting machine as claimed in claim 7, wherein the rim (36) of porous material of each longitudinal wall (33) of said distributor vessel (3) forms a descending lip set apart from the lower portion of said wall by a groove-shaped space (35), into which fits the upper edge (87) of the longitudinal wall (21) of said mold (2), said upper edge (87) being made to project above the joining plane P between said distributor vessel (3) and said mold (2), the bottom of said groove-shaped space (35) being separated from the top of said upper edge (87) by a space supplied with inert gas under pressure and forming the channel for injecting inert gas through said porous rim (36).

9. A continuous-casting machine as claimed in claim 3, wherein said distributor vessel (3) is limited by longitudinal and transverse walls arranged respectively in the extension of those of said mold (2).

* * * * *